US006102201A

United States Patent [19]

Marston et al.

[11] Patent Number: 6,102,201

[45] Date of Patent: Aug. 15, 2000

[54] BELT WORN GOLF ACCESSORY HOLDER

[76] Inventors: John P. Marston, 219 Prospect Pl., Ashland, Mass. 01721; Steven S. Praetsch, 607 Winter St., Holliston, Mass. 01746

[21] Appl. No.: 09/480,521

[22] Filed: Jan. 7, 2000

[51] Int. Cl.[7] ..... A63B 57/00

[52] U.S. Cl. ..... 206/315.1; 224/681; 224/918; 224/919

[58] Field of Search ..... 224/904, 918, 224/919, 660, 676, 677, 680, 681; 206/315.1, 315.9

[56] References Cited

U.S. PATENT DOCUMENTS 5,031,812 7/1991 Gustine ..... 224/918
5,772,090 6/1998 Rodriguez ..... 224/919

*Primary Examiner*—Jacob K. Ackun

[57] ABSTRACT

A belt worn golf accessory holder for holding tees, ball markers and divot repair tools to the belt of the golfer. The belt worn golf accessory holder includes a panel. The panel has a first portion and a second portion. Each of the first and second portions has a front side and a back side. The panel has a peripheral edge. The panel is foldable on a juncture of the first and second portions of panel. At least one loop for releasably mounting the panel to the belt is fixedly attached to the back side of the panel. At least one loop for releasably securing the accessories to the panel is fixedly coupled to the front side of the panel. At least one pocket is located on the front side of the panel. At least one ball marker mounting is fixedly mounted in the panel. The mounting is located on front side of the panel. A securing means releasably secures the first portion of the front side of the panel to the second portion of the front side of the panel.

13 Claims, 2 Drawing Sheets

BELT WORN GOLF ACCESSORY HOLDER

BACKGROUND OF THE INVENTION

1. Field of the Invention

The present invention relates to golf accessory holders and more particularly pertains to a new belt worn golf accessory holder for holding tees, ball markers and divot repair tools to the belt of the golfer.

2. Description of the Prior Art

The use of golf accessory holders is known in the prior art. More specifically, golf accessory holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,129,237; 4,886,196; U.S. Pat. Des. No. 274,830; U.S. Pat. Nos. 3,753,519; 5,842,621 and 4,736,877.

While these devices fulfill their respective, particular objectives and requirements, the aforementioned patents do not disclose a new belt worn golf accessory holder. The inventive device includes a panel. The panel has a first portion and a second portion. Each of the first and second portions has a front side and a back side. The panel has a peripheral edge. The panel is foldable on a juncture of the first and second portions of panel. At least one loop for releasably mounting the panel to the belt is fixedly attached to the back side of the panel. At least one loop for releasably securing the accessories to the panel is fixedly coupled to the front side of the panel. At least one pocket is located on the front side of the panel. At least one ball marker mounting is fixedly mounted in the panel. The mounting is located on front side of the panel. A securing means releasably secures the first portion of the front side of the panel to the second portion of the front side of the panel.

In these respects, the belt worn golf accessory holder according to the present invention substantially departs from the conventional concepts and designs of the prior art, and in so doing provides an apparatus primarily developed for the purpose of holding tees, ball markers and divot repair tools to the belt of the golfer.

SUMMARY OF THE INVENTION

In view of the foregoing disadvantages inherent in the known types of golf accessory holders now present in the prior art, the present invention provides a new belt worn golf accessory holder construction wherein the same can be utilized for holding tees, ball markers and divot repair tools to the belt of the golfer.

The general purpose of the present invention, which will be described subsequently in greater detail, is to provide a new belt worn golf accessory holder apparatus and method which has many of the advantages of the golf accessory holders mentioned heretofore and many novel features that result in a new belt worn golf accessory holder which is not anticipated, rendered obvious, suggested, or even implied by any of the prior art golf accessory holders, either alone or in any combination thereof.

To attain this, the present invention generally comprises a panel. The panel has a first portion and a second portion. Each of the first and second portions has a front side and a back side. The panel has a peripheral edge. The panel is foldable on a juncture of the first and second portions of panel. At least one loop for releasably mounting the panel to the belt is fixedly attached to the back side of the panel. At least one loop for releasably securing the accessories to the panel is fixedly coupled to the front side of the panel. At least one pocket is located on the front side of the panel. At least one ball marker mounting is fixedly mounted in the panel. The mounting is located on front side of the panel. A securing means releasably secures the first portion of the front side of the panel to the second portion of the front side of the panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new belt worn golf accessory holder apparatus and method which has many of the advantages of the golf accessory holders mentioned heretofore and many novel features that result in a new belt worn golf accessory holder which is not anticipated, rendered obvious, suggested, or even implied by any of the prior art golf accessory holders, either alone or in any combination thereof.

It is another object of the present invention to provide a new belt worn golf accessory holder which may be easily and efficiently manufactured and marketed.

It is a further object of the present invention to provide a new belt worn golf accessory holder which is of a durable and reliable construction.

An even further object of the present invention is to provide a new belt worn golf accessory holder which is susceptible of a low cost of manufacture with regard to both materials and labor, and which accordingly is then susceptible of low prices of sale to the consuming public, thereby making such belt worn golf accessory holder economically available to the buying public.

Still yet another object of the present invention is to provide a new belt worn golf accessory holder which provides in the apparatuses and methods of the prior art some of the advantages thereof, while simultaneously overcoming some of the disadvantages normally associated therewith.

Still another object of the present invention is to provide a new belt worn golf accessory holder for holding tees, ball markers and divot repair tools to the belt of the golfer.

Yet another object of the present invention is to provide a new belt worn golf accessory holder which includes a panel. The panel has a first portion and a second portion. Each of the first and second portions has a front side and a back side. The panel has a peripheral edge. The panel is foldable on a juncture of the first and second portions of panel. At least one loop for releasably mounting the panel to the belt is fixedly attached to the back side of the panel. At least one loop for releasably securing the accessories to the panel is fixedly coupled to the front side of the panel. At least one pocket is located on the front side of the panel. At least one ball marker mounting is fixedly mounted in the panel. The mounting is located on front side of the panel. A securing means releasably secures the first portion of the front side of the panel to the second portion of the front side of the panel.

Still yet another object of the present invention is to provide a new belt worn golf accessory holder that contains a pocket for holding money and various slots for insertion of credit cards.

Even still another object of the present invention is to provide a new belt worn golf accessory holder that folds over itself in order to ensure that the accessories do not fall out the holder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
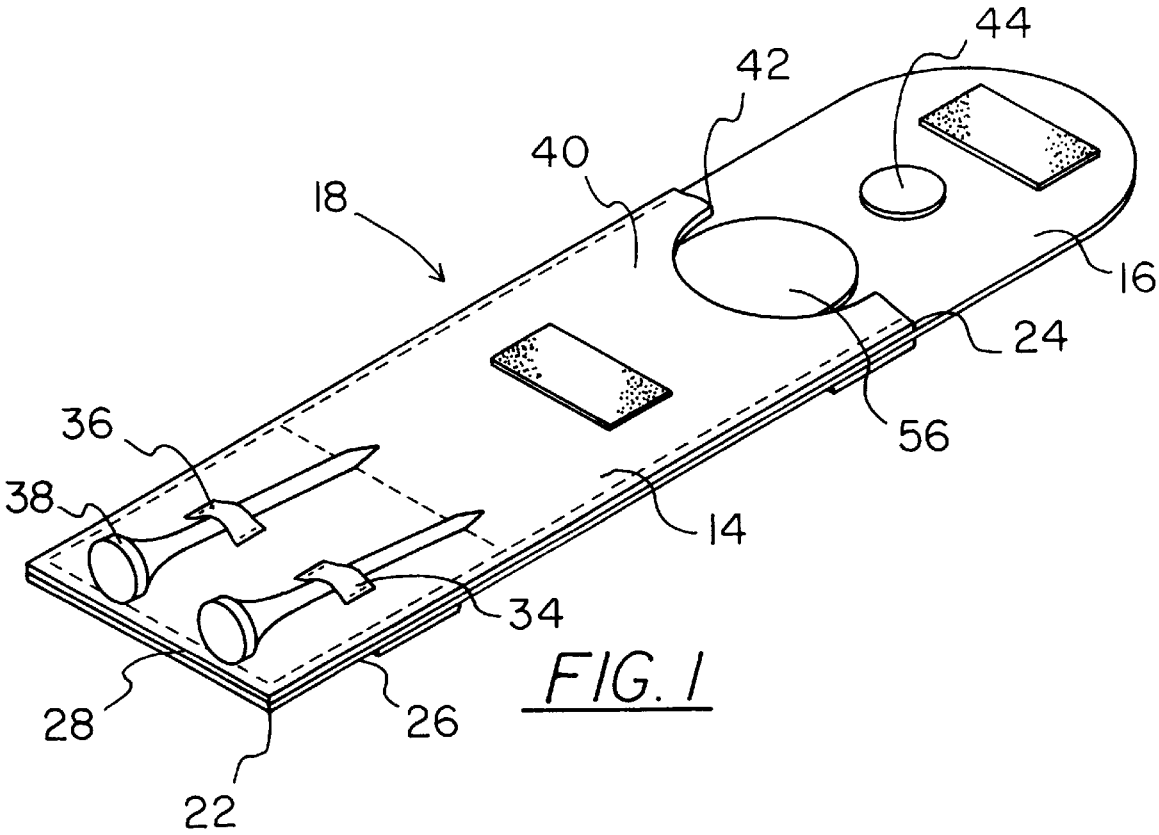
FIG. 1 is a schematic perspective view of the front side of the second embodiment of a new belt worn golf accessory holder according to the present invention.

With reference now to the drawings, and in particular to FIGS. 1 through 4 thereof, a new belt worn golf accessory holder embodying the principles and concepts of the present invention and generally designated by the reference numeral 10 will be described.

As best illustrated in FIGS. 1 through 4, the belt worn golf accessory holder 10 generally comprises a golf accessory holder releasably mountable to a belt.

The holder has a panel 12. The panel 12 has a first portion 14 and a second portion 16 and each of the first 14 and second portions 16 has a front side 18 and a back side 20. The panel 12 has a peripheral edge 22. The panel is foldable on a juncture 24 of the first 14 and second portions 16 of panel 12. The panel 12 has a pair of opposite edges 26, 28. Preferably, the panel 12 is rectangular and is made from cloth. The cloth can be made from either natural or synthetic fibers, including, but not limited to, cotton, polyester, silk, rayon, linen or wool. Additionally, the panel can be formed from natural or synthetic leather.

Figure 3:
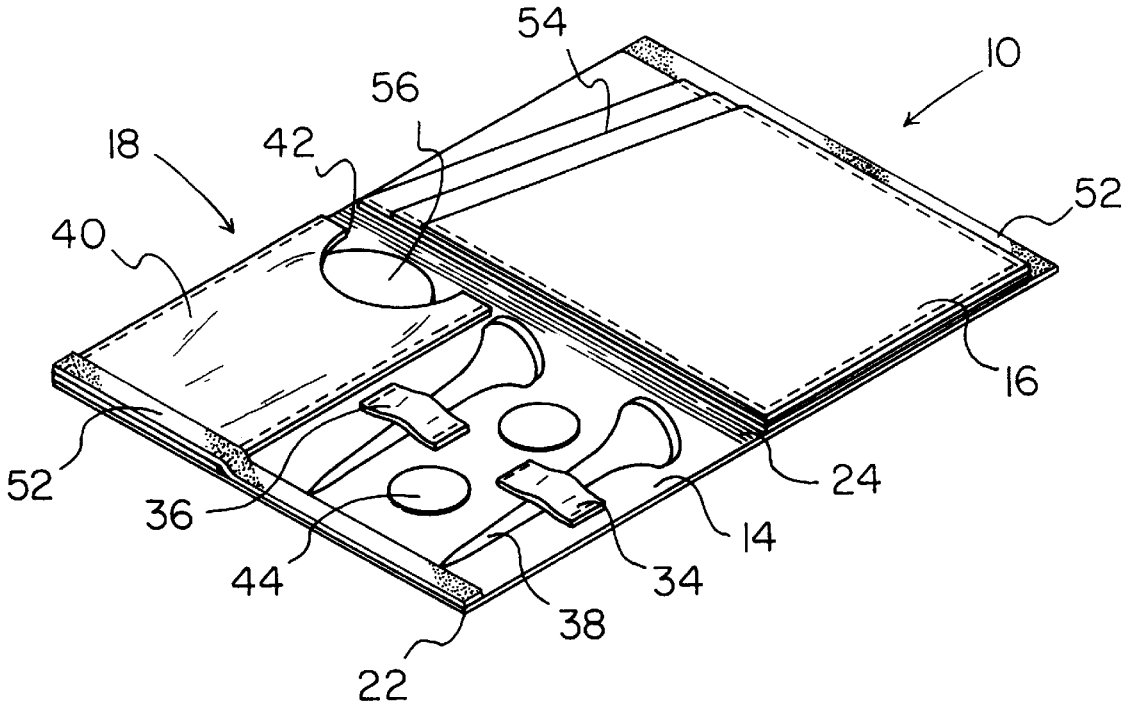
FIG. 3 is a schematic perspective view of the front side of the preferred embodiment of the present invention.
Figure 4:
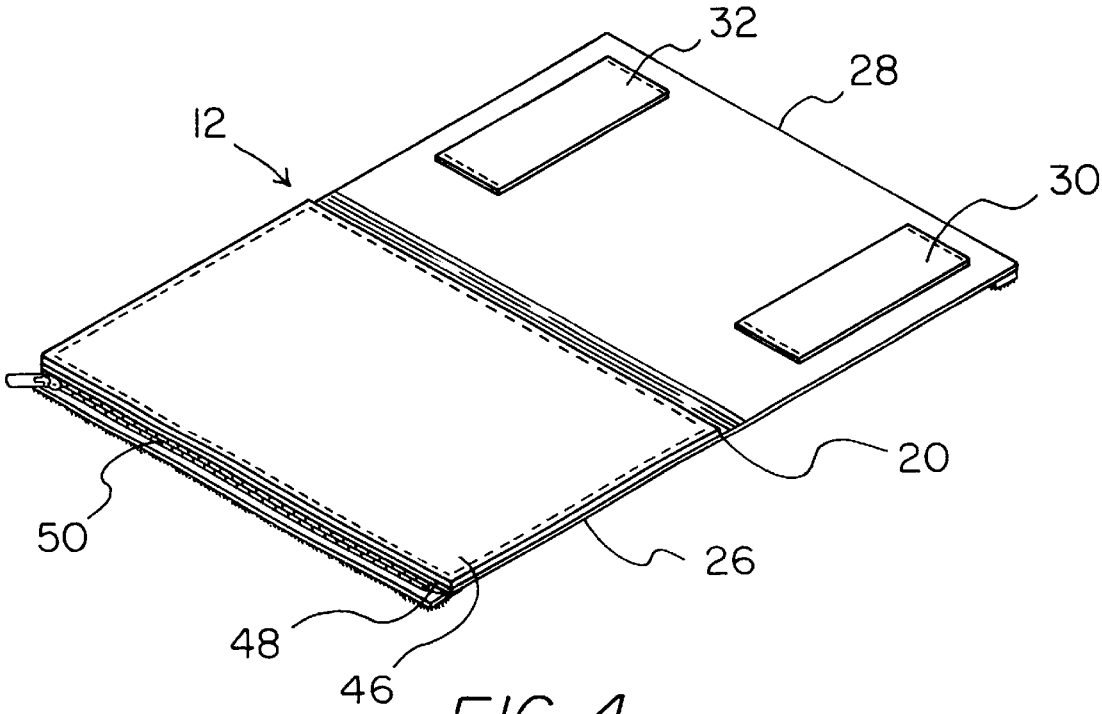
FIG. 4 is a schematic perspective view of the back side of the preferred embodiment of the present invention.

The preferred embodiment, as best depicted in FIGS. 3 and 4, has a first 30 and a second loop 32 for releasably mounting the panel 12 to the belt. The first 30 and the second loops 32 are fixedly attached to the back side 20 of the panel 12. The loops are oriented generally parallel to each other and are spaced. The loops 30, 32 are preferably located adjacent to opposite edges 26 of the panel.

The preferred embodiment has a third 34 and fourth 36 loop for releasably securing the accessories to the panel 12. The third 34 and fourth loops 36 are fixedly coupled to the first portion 14 of the front side 18 of the panel 12. Each has a longitudinal axis. Preferably, the longitudinal axes of the third 34 and fourth 36 loops are oriented generally parallel. Ideally, the third 34 and fourth 36 loops substantially share a longitudinal axis. The third 36 and fourth 36 loops are preferably formed from elastic material. A golf tee 38 may be inserted in each of the third 34 and fourth 36 loops.

A first pocket 40 is located on the first portion 14 of the front side 18 of the panel 12. In the preferred embodiment, the first pocket 40 is adjacent to the peripheral edge 22 of the panel. The first pocket has four edges, wherein one of the edges 42 is an open edge. Ideally, the open edge 42 of the first pocket is directed toward the juncture 24 between the first portion and the second portion of the panel.

The preferred embodiment a pair of mountings 44. Each of the mountings 44 are adapted to allow a ball marker to be snapped into the mounting. The mountings are fixedly mounted in the panel 12. The mountings are preferably located on the first portion 14 of the front side 18 of the panel 12 between the third 34 and the fourth loops 36. Each of the mountings 44 is generally circular and a ball marker may be held against the front side of the first portion by each of the mountings. Another embodiment, not shown, would utilize magnetic mountings, which would hold a metallic ball marker in place by magnetic forces. The magnetic mounting would be similarly mounted in the panel 12.

The preferred embodiment contains a second pocket 46. The second pocket 46 is fixedly coupled to the second portion 16 of the back side 20 of the panel 12. The second pocket 46 has four edges, wherein one of the edges 48 is an open edge of the second pocket. The open edge 48 of the pocket one of the edge is preferably directed away from the juncture 24 of the first and second portions of the panel. The open edge 48 of the second pocket is adjacent to a peripheral edge of the panel, wherein money or other items may be held in the second pocket 46.

A fastening means fastens the open edge 48 of the second pocket 46 to an adjacent peripheral 22 edge of the panel 12. The fastening means is preferably a zipper 50.

A securing means for releasably securing the first portion 14 of the front side 18 of the panel 12 to the second portion 16 of the front side 18 of the panel 12 is preferably located on a peripheral edge of the panel generally adjacent to the zipper 50 and generally adjacent to an opposite peripheral edge of the panel. Ideally, the securing means is a hook and loop means 52, wherein folding the panel on the juncture releasably joins the securing means.

The preferred embodiment may also contain additional pockets 54 on the front side of the second portion of the panel. These pockets can be used for credit cards and other similarly shaped items.

Figure 2:
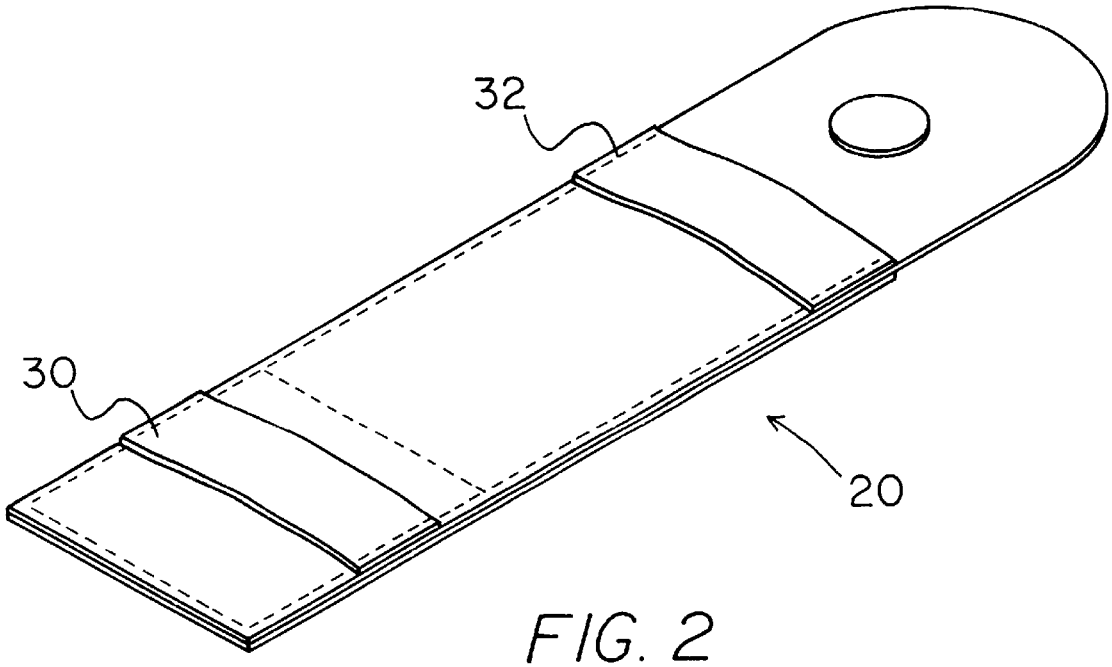
FIG. 2 is a schematic perspective view of the back side of the second embodiment of the present invention.

The second embodiment, as best depicted in FIGS. 1 and 2. there is no second pocket. The second embodiment is generally smaller and only contains one ball marker mounting 44.

In use, placing the belt through the first 30 and second 32 loops places the panel 12 on a belt of the user. A ball divot repair tool 56 is placed in the first pocket 40. Tees 38 are placed in the third 34 and fourth 36 loops. Ball markers are snapped to the mountings 44. The first portion 14 is secured to the second portion 16 by way of the hook and loop securing means 52 to insure all of the accessories do not fall out.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A golf accessory holder, the holder being releasably mountable on a belt, said holder comprising:

a panel, said panel having a first portion and a second portion, each of said first and second portions having a front side and a back side, said panel having a peripheral edge, wherein said panel is foldable on a juncture of said first and second portions of panel;

at least one loop for releasably mounting said panel to said belt, said loop being fixedly attached to said back side of said panel;

at least one loop for releasably securing said accessories to said panel, said loop being fixedly coupled to said front side of said panel;

at least one pocket, said pocket being located on said front side of said panel;

at least one mounting, said mounting being adapted for having a ball marker removably snapped thereon, mounting being fixedly mounted in said panel, said mounting being located on front side of said panel;

a securing means for releasably securing said first portion of said front side of said panel to said second portion of said front side of said panel.

2. The golf accessory holder as in claim 1, said panel comprises:

said panel being generally rectangular, said panel being made from cloth.

3. The golf accessory holder as in claim 1, wherein at least one loop for releasably mounting said panel to a belt is a first and second loop, said first and second loops comprising:

said first and said second loops being fixedly attached to said back side of said panel, said loops being oriented generally parallel to each other, said loops being spaced.

4. The golf accessory holder as in claim 1, wherein at least one loop for releasably securing said accessories to said panel is a third and fourth loop, said third and fourth loops comprising:

said third and fourth loops being fixedly coupled to said first portion of said front side of said panel, said third and fourth loops each having a longitudinal axis, said longitudinal axes of said third and fourth loops being oriented generally parallel, said third and fourth loops being formed from elastic material, wherein where a golf tee may be inserted in each of said third and fourth loops.

5. The golf accessory holder as in claim 1, said pocket comprises:

said first pocket being adjacent to said peripheral edge of said panel, said first pocket having four edges, wherein one of said edges is an open edge, said open edge of said first pocket being directed toward the juncture between said first portion and said second portion of said panel.

6. The golf accessory holder as in claim 4, wherein the mountings are a pair of mountings, said pair of mountings comprise:

each of said mountings being fixedly mounted in said panel, each of said mountings being located on said first portion of said front side of said panel, each of said mountings being generally between said third and said fourth loops, each of said mountings being generally circular, wherein a ball marker may be removably snapped into each of said mountings and be held against said front side of said first portion by each of said mountings.

7. The golf accessory holder as in claim 1, wherein said pocket is a first and second pocket, said second pocket comprises:

said second pocket being fixedly coupled to said second portion of said back side of said panel, said second pocket having four edges, wherein one of said edges is an open edge of said second pocket.

8. The golf accessory holder as in claim 7, further comprising:

a fastening means for fastening said open edge of said second pocket to an adjacent peripheral edge of said panel.

9. The golf accessory holder as in claim 8, wherein said fastening means is a zipper.

10. The golf accessory holder as in claim 9, said securing means comprises:

said securing means being located on a peripheral edge of said panel generally adjacent to said zipper and generally adjacent to an opposite peripheral edge of said panel, wherein said securing means is a hook and loop means, wherein folding said panel on said juncture releasably joins said securing means.

11. The golf accessory holder as in claim 1, said securing means comprises:

said securing means being located on said first portion of said front side of said panel and on said second portion of said front side of said panel, said securing means being a hook and loop means, wherein folding said panel on said juncture releasably joins said securing means.

12. The golf accessory holder as in claim 1, said panel comprises:

said panel being generally rectangular, said panel being made from leather.

13. A golf accessory holder, the holder being releasably mountable on a belt, said holder comprising:

a panel, said panel having a first portion and a second portion, each of said first and second portions having a front side and a back side, said panel having a peripheral edge, wherein said panel is foldable on a juncture of said first and second portions of panel, said panel having a pair of opposite edges, said panel being generally rectangular, said panel being made from cloth;

a first and a second loop for releasably mounting said panel to said belt, said first and said second loops being fixedly attached to said back side of said panel, said loops being oriented generally parallel to each other, said loops being spaced, said loops being generally located adjacent to opposite edges of said panel;

a third and fourth loop for releasably securing said accessories to said panel, said third and fourth loops being fixedly coupled to said first portion of said front side of said panel, said third and fourth loops each having a longitudinal axis, said longitudinal axes of said third and fourth loops being oriented generally parallel, wherein said third and fourth loops substantially share a longitudinal axis, said third and fourth loops being formed from elastic material, wherein where a golf tee may be inserted in each of said third and fourth loops;

a first pocket, said first pocket being located on said first portion of said front side of said panel, said first pocket being adjacent to said peripheral edge of said panel, said first pocket having four edges, wherein one of said edges is an open edge, said open edge of said first pocket being directed toward the juncture between said first portion and said second portion of said panel;

a pair of mountings, each of said mountings being adapted to having a ball marker releasably snapped thereto, each of said mountings being fixedly mounted in said panel, each of said mountings being located on said first portion of said front side of said panel, each of said mountings being generally between said third and said fourth loops, each of said mountings being generally circular, wherein a ball marker may be held against said front side of said first portion by each of said mountings;

a second pocket, said second pocket being fixedly coupled to said second portion of said back side of said panel, said second pocket having four edges, wherein one of said edges is an open edge of said second pocket, said open edge of said pocket one of said edge being directed away from said juncture of said first and second portions of said panel, said open edge of said second pocket being adjacent to a peripheral edge of said panel;

a fastening means for fastening said open edge of said second pocket to an adjacent peripheral edge of said panel, said fastening means being a zipper;

a securing means for releasably securing said first portion of said front side of said panel to said second portion of said front side of said panel, said securing means being located on a peripheral edge of said panel generally adjacent to said zipper and generally adjacent to an opposite peripheral edge of said panel, wherein said securing means is a hook and loop means, wherein folding said panel on said juncture releasably joins said securing means.

* * * * *